US007938869B2

(12) United States Patent
Kang

(10) Patent No.: US 7,938,869 B2
(45) Date of Patent: May 10, 2011

(54) APPARATUS FOR PURIFYING AND HUMIDIFYING AIR

(75) Inventor: Woo Jin Kang, Goyang-si (KR)

(73) Assignee: Woongjin Coway Co., Ltd., Gongju-si, Chungcheongnam-do (KR)

( * ) Notice: Subject to any disclaimer, the term of this patent is extended or adjusted under 35 U.S.C. 154(b) by 204 days.

(21) Appl. No.: 12/328,536

(22) Filed: Dec. 4, 2008

(65) Prior Publication Data

US 2009/0139408 A1 Jun. 4, 2009

(30) Foreign Application Priority Data

Dec. 4, 2007 (KR) ..... 10-2007-0125073
Dec. 28, 2007 (KR) ..... 10-2007-0140467
Nov. 12, 2008 (KR) ..... 10-2008-0112231

(51) Int. Cl.
*B01D 50/00* (2006.01)

(52) U.S. Cl. ..... 55/312; 55/471; 96/417; 261/118

(58) Field of Classification Search ..... 55/309, 55/312, 467, 471; 261/118; 96/417
See application file for complete search history.

(56) References Cited

U.S. PATENT DOCUMENTS 2,994,405 A * 8/1961 Barach et al. ..... 423/210
4,564,375 A 1/1986 Munk et al. ..... 55/259
5,578,113 A 11/1996 Glenn ..... 96/52

FOREIGN PATENT DOCUMENTS

GB 896885 5/1962
JP 04-011094 1/1992
JP 2008-035998 2/2008
JP 2008-036495 2/2008

OTHER PUBLICATIONS

Extended European Search Report dated Apr. 2, 2009 for corresponding European Application No. 08021011.5-2301.

* cited by examiner

*Primary Examiner* — Robert A Hopkins

(74) *Attorney, Agent, or Firm* — Ohlandt, Greeley, Ruggiero & Perle, L.L.P.

(57) ABSTRACT

An apparatus for purifying and humidifying air which enables separate supply of purified air and humidified air and controls the amount of humidified air discharged and which includes dual flow paths to increase the efficiency of air transfer. The apparatus includes a case having a suction port through which external air is introduced thereinto and a discharge port through which the introduced air is discharged, a circulation fan for causing the introduced air to flow toward the discharge port, a filter unit disposed in the case to filter the introduced air, a humidification unit disposed at a low position in the case to supply the air passed through the filter unit with moisture, and a flow path control unit disposed between the suction port and the humidification unit to control flow of the air passed through the filter unit.

12 Claims, 13 Drawing Sheets

APPARATUS FOR PURIFYING AND HUMIDIFYING AIR

BACKGROUND OF THE INVENTION

1. Field of the Invention

The present invention relates to an apparatus for purifying air, and more particularly to an apparatus for purifying and humidifying air which includes dual flow paths and may further function as a humidifier.

2. Description of the Prior Art

An air purifier, which is constructed to purify contaminated air thus making clean air, functions by passing air through a filter to remove dust, bacteria and unpleasant odors from air.

With the increase of yellow sand, harmful dust and the like, air pollution has become serious and thus respiratory diseases caused by air pollution have increased. Due to the social atmosphere in which the public interest paid to health has increased, the need and demand for an air purifier are drastically increasing.

A typical air purifier includes a fan for drawing air to be purified into the air purifier, and a filter assembly for purifying the air. In particular, the filter assembly includes a plurality of filters having various pore sizes and a filter frame supporting the filters. Examples of the filter may include a preprocessing filter made of antibacterial material which functions to remove relatively large dust particles, mold, the hair of pet animals and the like, a washing filter and a HEPA filter.

Meanwhile, the air purifier may further include a humidification filter which is configured to humidify air and to offer humidified air having a predetermined humidity, in addition to the above filters. Thanks to the humidification filter, impurities contained in the air are removed, and air containing moisture is supplied, thus enabling control of indoor humidity.

FIG. 1 is a cross-sectional view of a conventional apparatus for purifying and humidifying air. As shown in FIG. 1, the apparatus comprises a body housing 11 and a front cover 20 detachably mounted on the body housing 11. The front cover 20 has a suction inlet through which external air is introduced into the body housing 11. The introduced air is passed through a filter unit 23 composed of a plurality of filters, and is thus purified. The purified air is introduced into a blower fan housing 28 accommodating a blower fan 25 through a blower fan inlet 27 formed at the front side of the blower fan housing 28, and is then discharged from the apparatus through a discharge outlet. A humidification filter 22 is disposed at a low position in the front of the blower fan 25. Some of the purified air which has passed through the filter unit 23 passes through the humidification filter 22, resulting in humidified, clean air. The humidified clean air is also introduced into the blower fan housing 28 through the blower fan inlet 27, and is then discharged through the discharge outlet 29.

Unfortunately, the conventional apparatus for purifying and humidifying air is disadvantageous because the operations of air purification and air humidification cannot be independently performed. In other words, as shown in the drawing, the purified air and the humidified air are discharged together. Consequently, there is a problem in that the humidified air is continuously supplied regardless of the humidity of the outside air. Furthermore, since the conventional apparatus is configured to permit air to be introduced thereinto only through the front side of the blower fan, the efficiency of air treatment is negatively impacted. In this context, it is to be understood that air purification refers solely to the treatment of purifying air through a general filter without doing the humidification.

SUMMARY OF THE INVENTION

Accordingly, the present invention has been made keeping in mind the above problems occurring in the related art, and an object of the present invention is to provide an apparatus for purifying and humidifying air, which is configured to enable separate supply of purified air and humidified air and to control the amount of humidified air discharged and which includes dual flow paths disposed before and after a circulation fan to increase the efficiency of air transfer.

In order to accomplish the above object, the present invention provides an apparatus for purifying and humidifying air, including: a case having a suction port through which external air is introduced thereinto and a discharge port through which the introduced air is discharged; a circulation fan for causing the introduced air to flow to the discharge port; a filter unit disposed in the case to filter the introduced air; a humidification unit disposed at a low position in the case to supply the air passed through the filter unit with moisture; and a flow path control unit disposed between the suction port and the humidification unit to control flow of the air passed through the filter unit.

The flow path control unit may be operated to selectively provide access to an air purification path in which the purified air passed through the filter unit flows through at least one of spaces before and behind the circulation fan and toward the discharge port; or to an air purification and humidification path in which the purified air passed through the filter unit is humidified by the humidification unit and then flows through at least one of the spaces before and behind the circulation fan and toward the discharge port.

The flow path control unit may be supportably mounted in the case, and may be moved between a first position in which the flow path control unit blocks the air purification and humidification path to allow the air passed through the filter unit to flow through the air purification path, and a second position in which the flow path control unit blocks the air purification path to allow the air passed through the filter unit to flow through only the air purification and humidification path.

The flow path control unit may be moved to a third position in which some of the air passed through the filter unit flows through the air purification path and the remainder of the air passed through the filter unit flows through the air purification and humidification path, wherein the third position is positioned between the first position and the second position.

The flow path control unit may include a rotating plate having a rotating shaft, in which the rotating shaft is rotated using drive power from a drive unit and the rotating plate is rotatably moved about the rotating shaft as central axis between the first position and the second position.

The flow path control unit may include a mill wheel-shaped rotating plate rotatably moved between the first position and the second position having a rotating shaft, in which the rotating shaft is rotated using drive power from a drive unit and the mill wheel-shaped rotating plate includes a support plate coupled to an end of the rotating shaft and four blades supported to the support plate and having a cruciform section extending from the rotating shaft, wherein at least one of the four blades has an opening area and a remainder of the four blades have a blind area.

The flow path control unit may include a sliding plate disposed behind and close to the filter unit, in which the sliding plate is slidably moved between the first position and the second position using drive power from a drive unit and has an upper opening area and a lower blind area.

Each of the air purification path and the air purification and humidification path may include dual flow paths composed of a front flow path defined between a front side of the circulation fan and the filter unit and a rear flow path defined between a rear side of the circulation fan and the case.

The humidification unit may be disposed below the circulation fan.

The humidification unit may include a humidification filter containing moisture and supplying air with the moisture, and a water tank accommodating a part of the humidification filter immersed therein and supplying the humidification filter with water.

The drive unit may be controlled by a controller in response to a signal received from an input unit provided outside the case.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

A preferred embodiment of the present invention will be described in greater detail with reference to the accompanying drawings.

Figure 1:
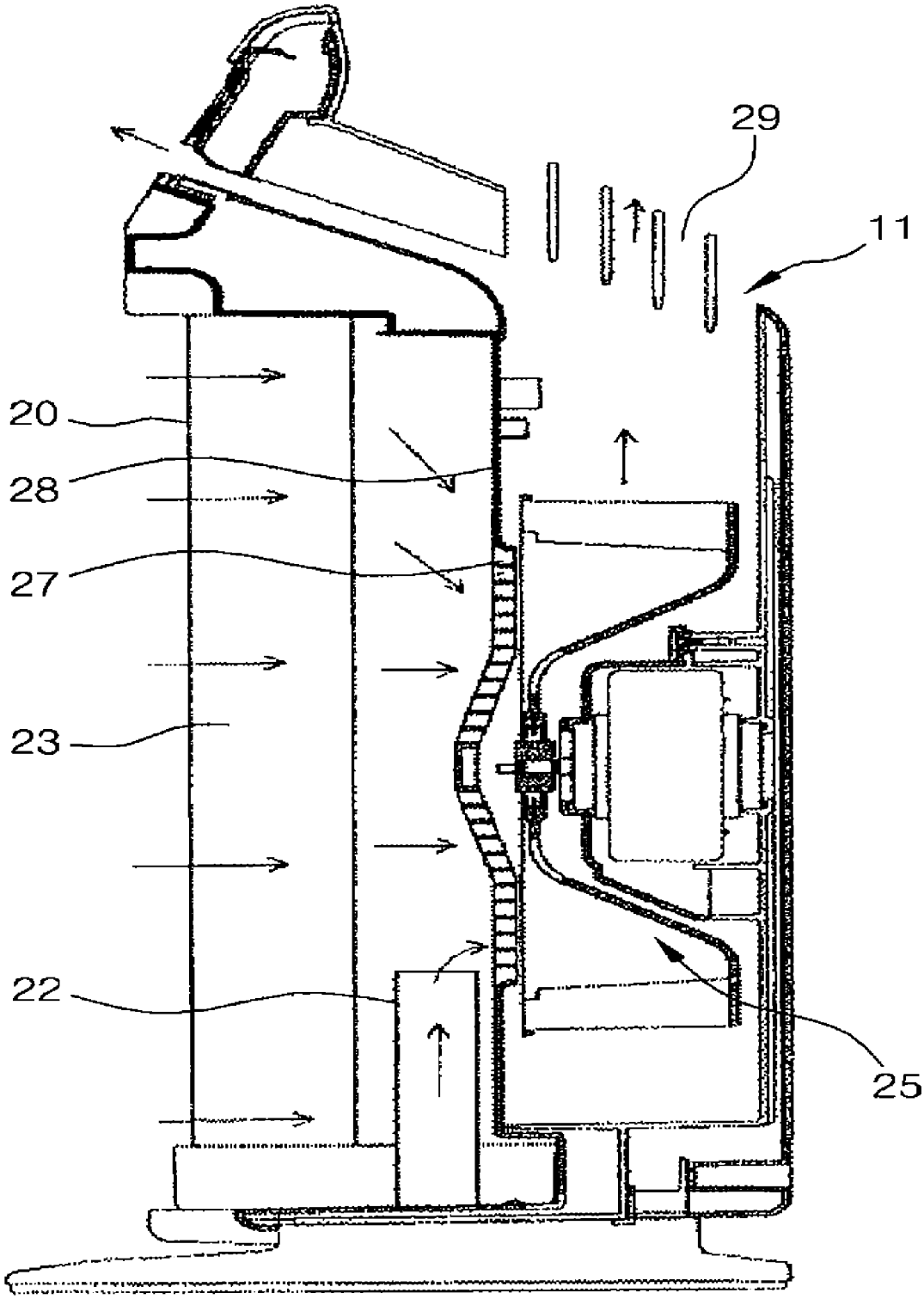
FIG. 1 is a cross-sectional view of a conventional apparatus for purifying and humidifying air.
Figure 2:
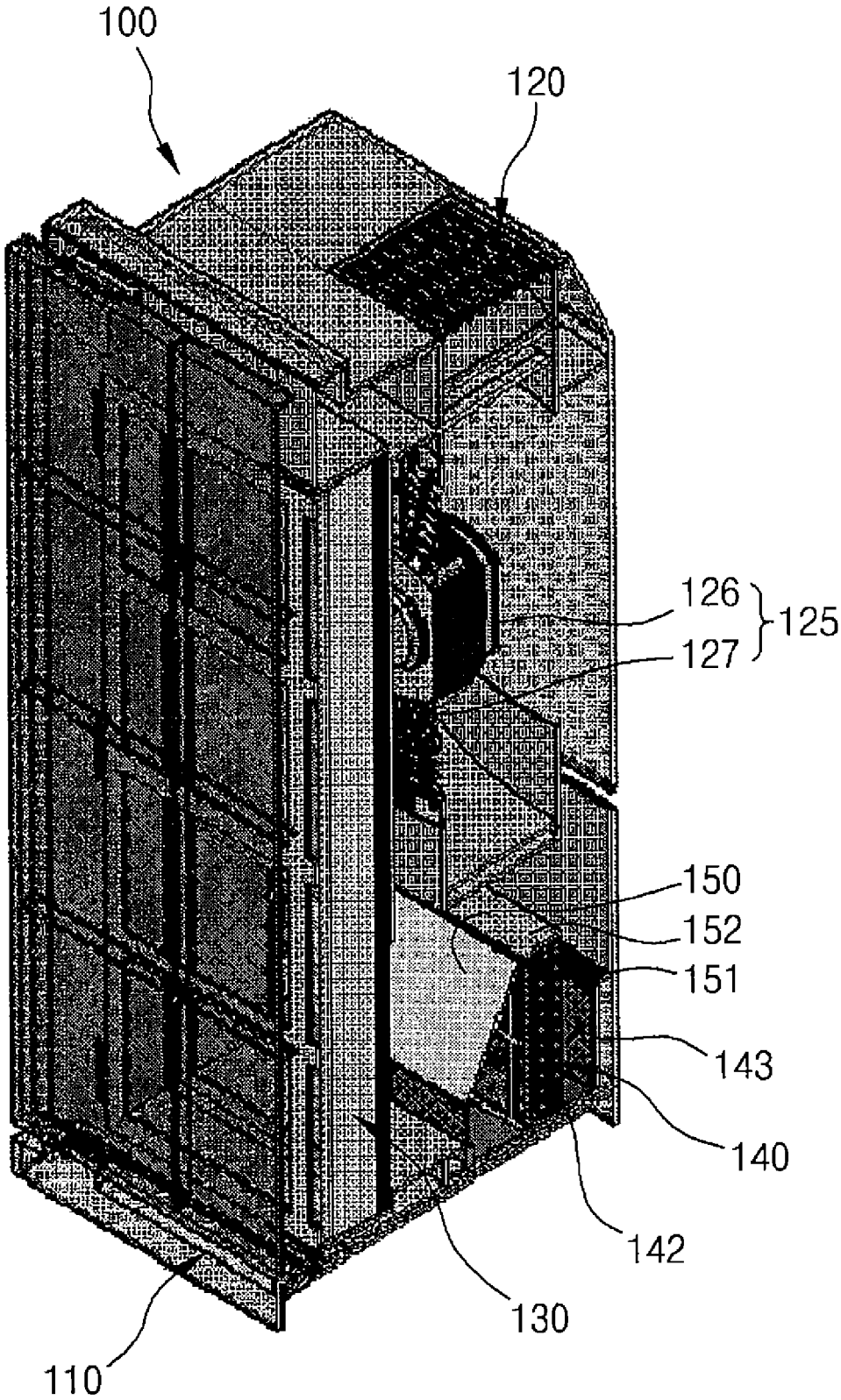
FIG. 2 is a perspective view of an apparatus for purifying and humidifying air according to an embodiment of the present invention with a right part of a case being cut away, in which a rotating plate serving as a flow path control unit is moved to a first position.
Figure 3:
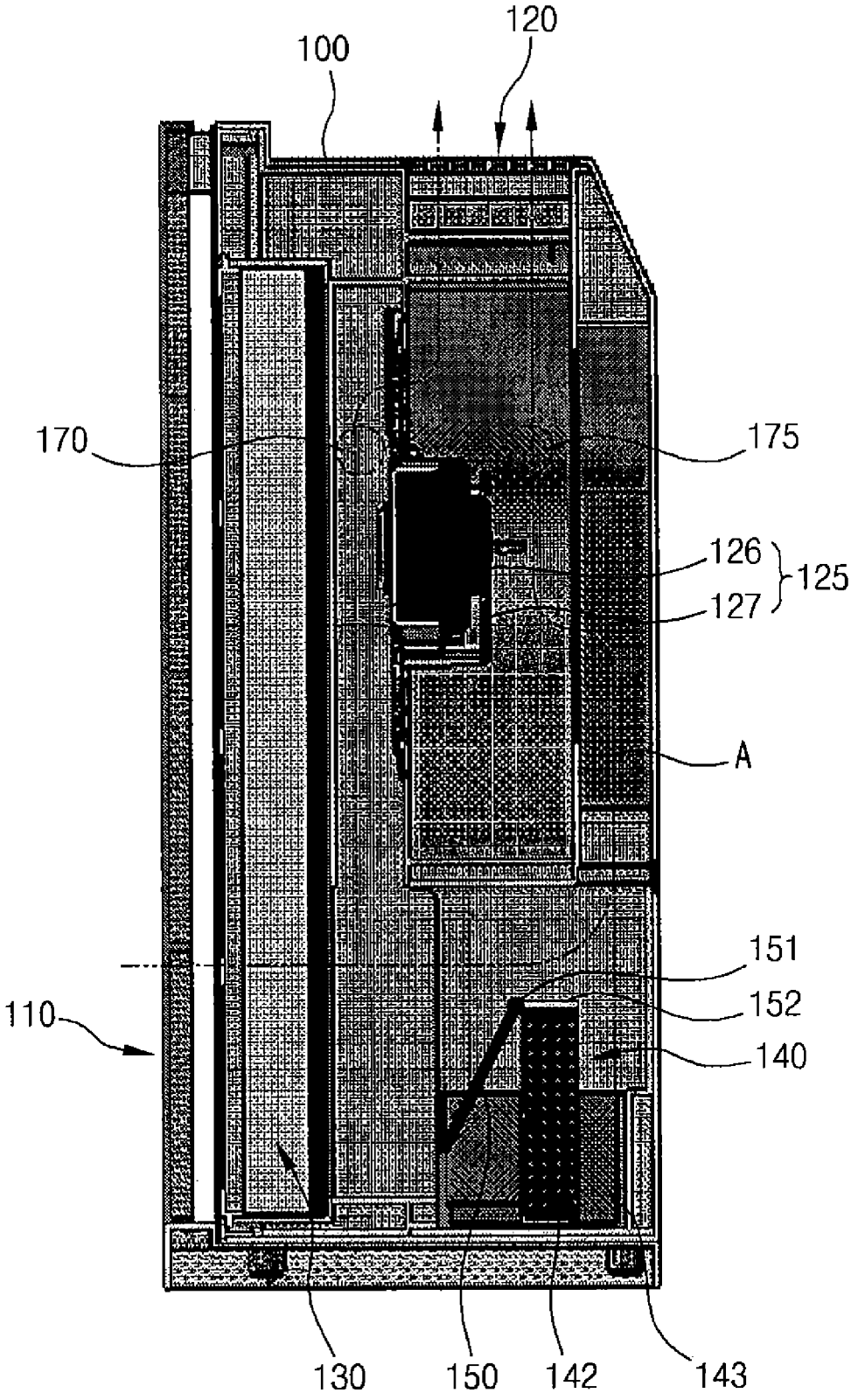
FIG. 3 is a side cross-sectional view of FIG. 2.
Figure 4:
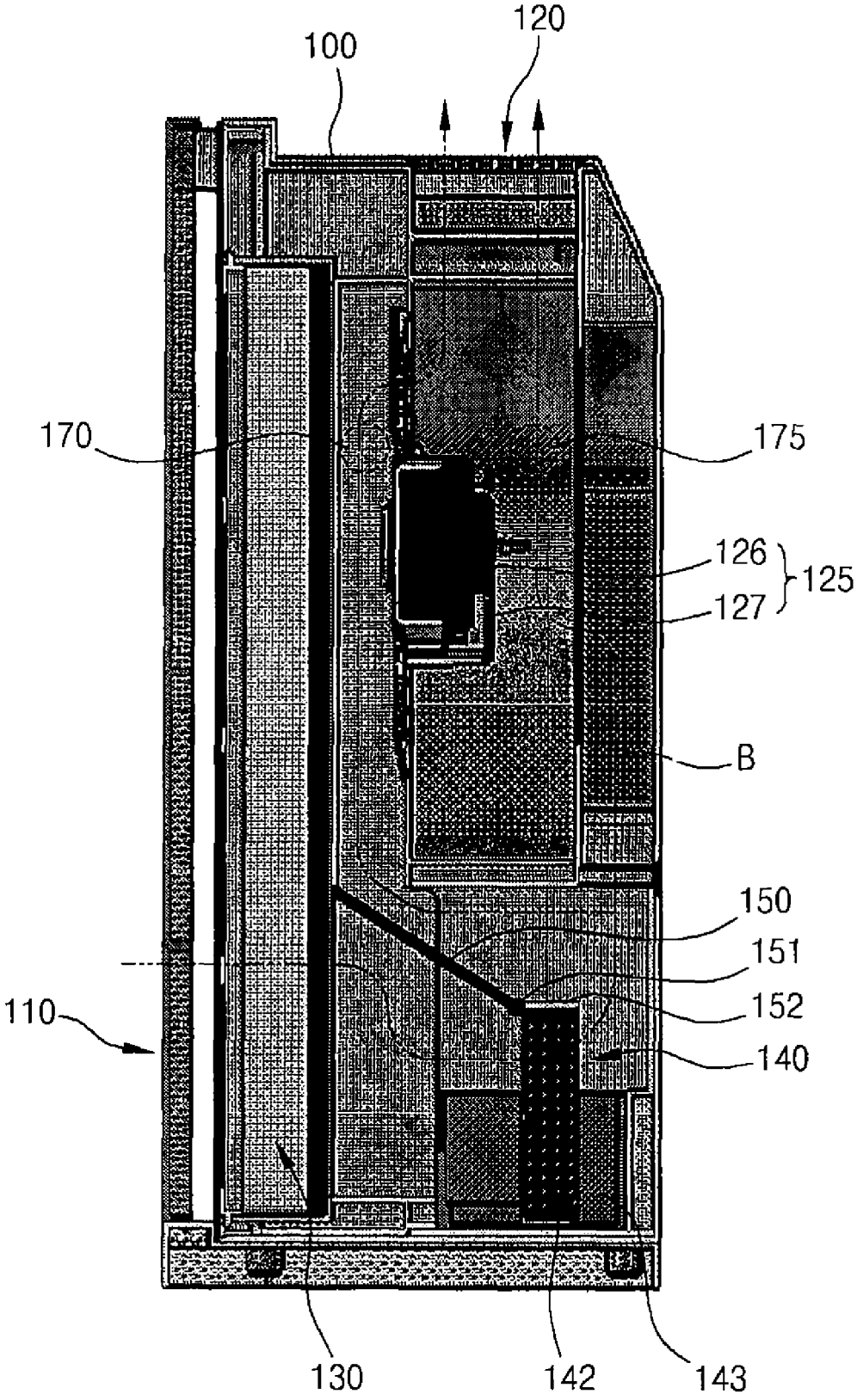
FIG. 4 is a side cross-sectional view of FIG. 2, in which the rotating plate is moved to a second position.
Figure 5:
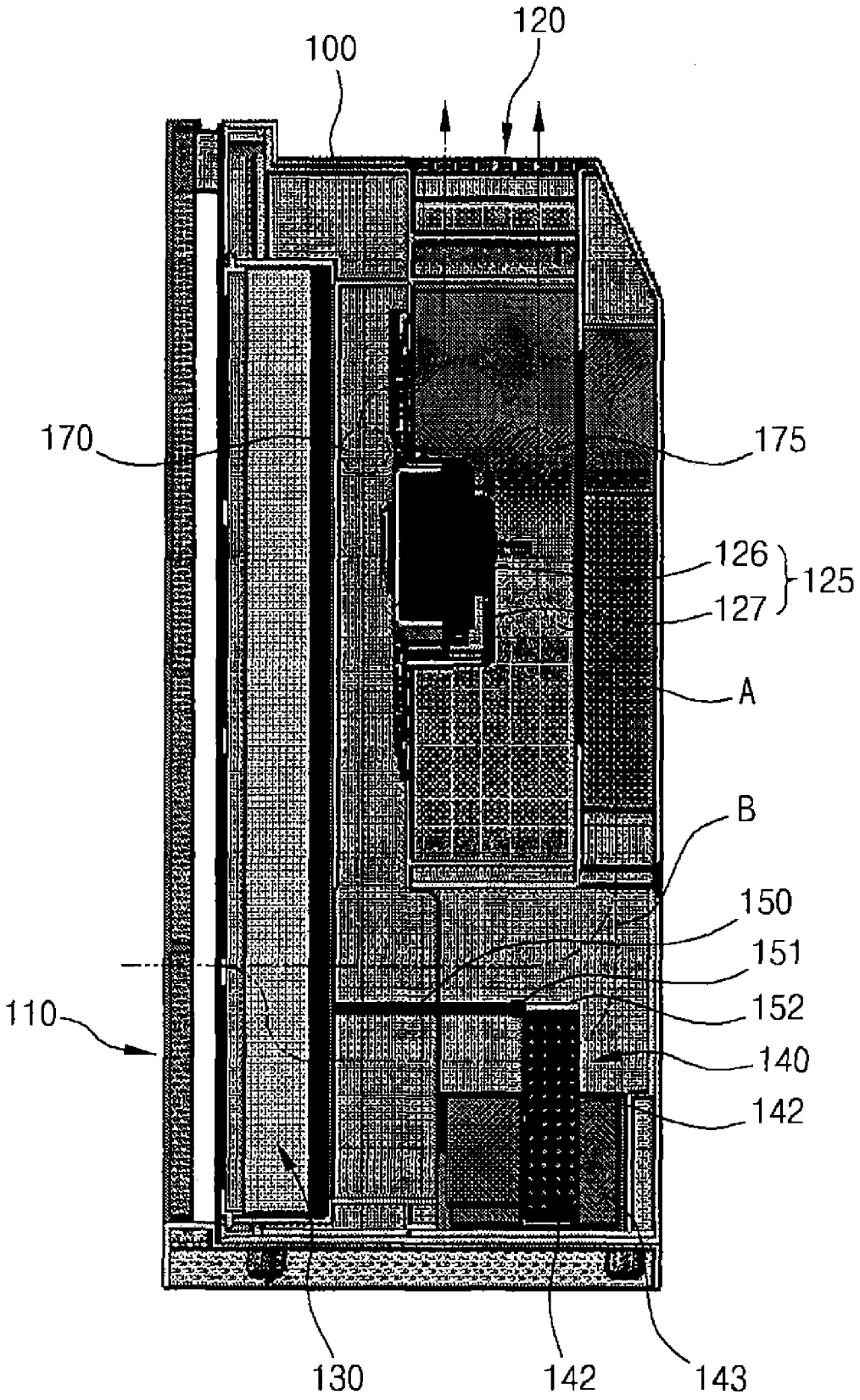
FIG. 5 is a side cross-sectional view of FIG. 2, in which the rotating plate is moved to a third position.
Figure 6:
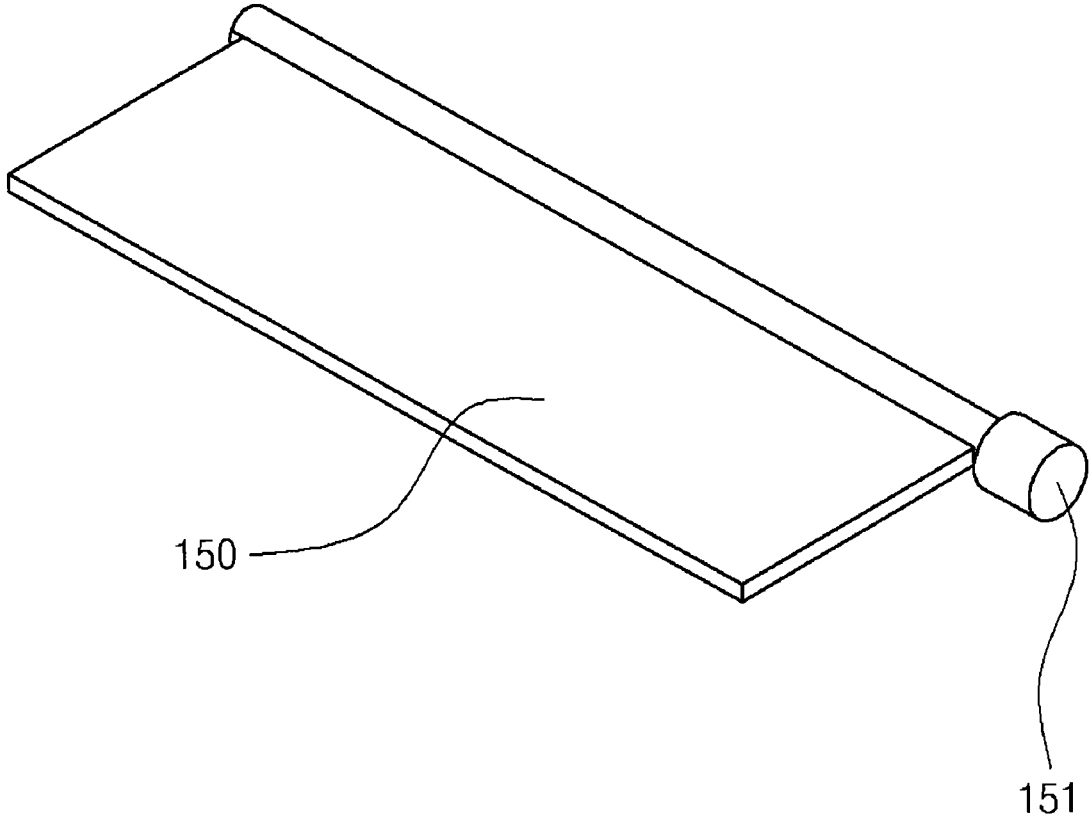
FIG. 6 shows a perspective view of the rotating plate which is a first embodiment of a flow path control unit, and an end view showing an operation of the rotating plate.
Figure 6:
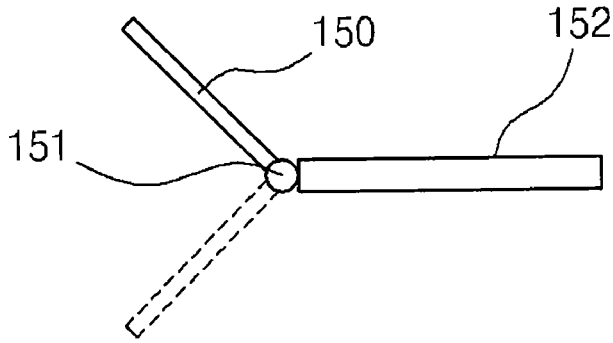
Figure 7:
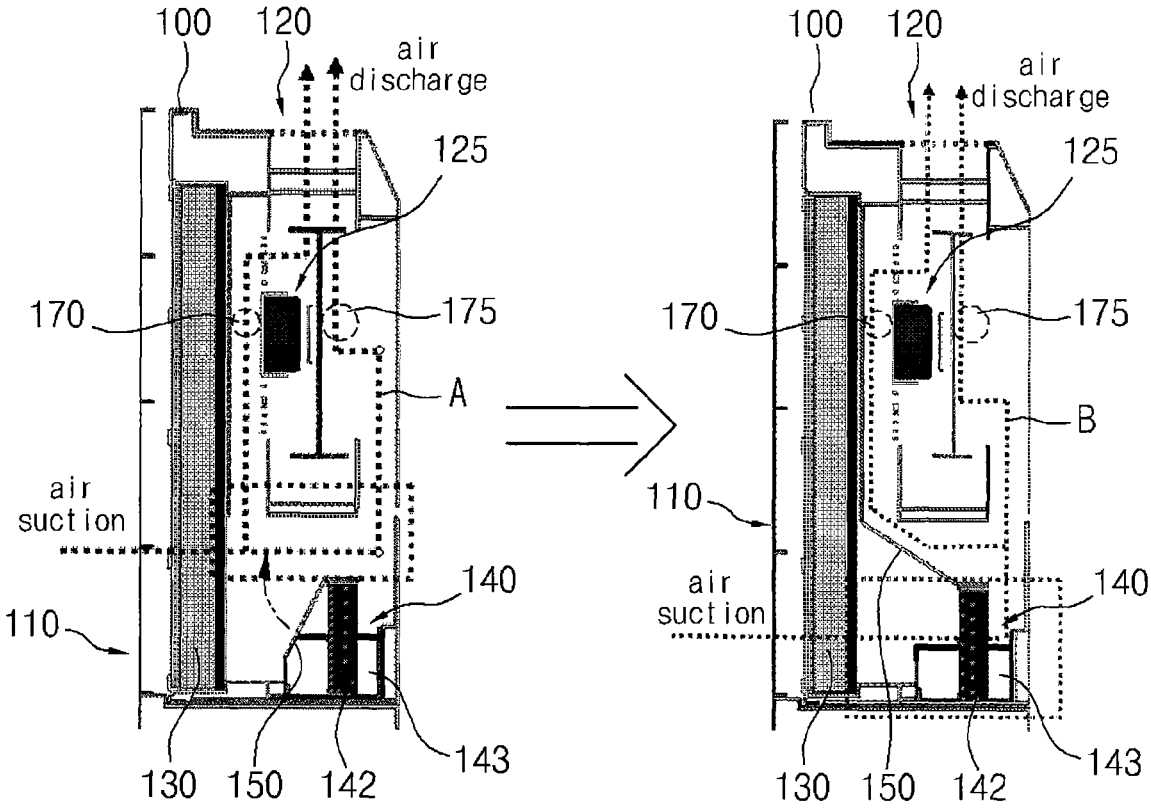
FIG. 7 is a schematic view showing respective air flows in the apparatus for purifying and humidifying air shown FIGS. 2 and 4.

FIG. 2 is a perspective view of an apparatus for purifying and humidifying air according to an embodiment of the present invention with a right part of a case being cut away, in which a rotating plate serving as a flow path control unit is moved to a first position, FIG. 3 is a side cross-sectional view of FIG. 2, FIG. 4 is a side cross-sectional view of FIG. 2 in which the rotating plate is moved to a second position, FIG. 5 is a side cross-sectional view of FIG. 2 in which the rotating plate is moved to a third position, FIG. 6 shows a perspective view of the rotating plate which is a first embodiment of a flow path control unit and a end view showing an operation of the rotating plate, and FIG. 7 is a schematic view showing respective air flows in the apparatus for purifying and humidifying air shown FIGS. 2 and 4.

As shown in FIGS. 2 to 7, the apparatus for purifying and humidifying air according to an embodiment of the present invention comprises a case 100 having a suction port 110 through which external air is introduced and a discharge port 120 through which treated air is discharged, a circulation fan 125 which is rotated to cause air introduced through the suction port 110 of the case to flow toward the discharge port 120, a filter unit 130 disposed at one side of the case 100 to filter the air introduced through the suction port 110, a humidification unit 140 disposed at a low position in the case 1000 to supply the air passed through the filter unit 130 with moisture, and a flow path control unit for controlling the flow of the air passed through the filter unit 130.

The filter unit 130 is detachably installed in the case 100, and is typically constructed of a pre-filter, a deodorization filter and a dust-collecting filter which are sequentially mounted on a filter support in that order starting from the air entrance. Since kinds and materials of the filters are well known in the art, detailed explanations thereof will be omitted in the following description. In this context, it is to be noted that the arrangement sequence of the filters are not restricted to this embodiment and that the filters may be arranged in various combinations.

The humidification unit 140 may be positioned under the circulation fan, and may include a humidification filter 142 containing moisture evenly dispersed therein and a water tank 143 which stores water and accommodates a lower part of the humidification filter 142 which is immersed therein. In this regard, the water tank 143 may be detachably installed on the case 100.

The humidification filter according to the present invention is not limited to any particular material or structure. For example, the humidification unit 140 may have any structure such as a hexahedral structure, a honeycomb structure, a structure composed of parallel plates or a foamed structure and a nonwoven fabric structure which have pores, holes, gaps or clearances to allow air to pass therethrough. Furthermore, the humidification unit 140 may be made of any material such as cloth, paper, nonwoven fabric, polyurethane foam, permeable film, porous material or combinations thereof which are capable of containing moisture as a result of capillary action and are capable of allowing the moisture to evaporate with the passage of air.

The circulation fan 125 is disposed at a rear position in the case 100, and may be of a double fan type which includes front and rear impellers 126 to cause easy introduction of air through the suction port 110 of the case 100. The front and rear impellers 126 may be disposed on a vertical plate 127 in the case 100.

The suction port 110 is disposed at a lower region of the front side of the case 100, and the discharge port 120 is disposed at the top surface of the case 100. The circulation fan 125 is disposed behind an upper region of the filter unit 130 below the discharge port 120. Accordingly, the air, which is introduced through the suction port 110 positioned at a low region of the case 100 through operation of the circulation fan 125, passes through the filter unit 130, and then flows upwards in the case 100. Then, the air is discharged into a room through the discharge port 120.

The flow of air from the filter unit 130 to the humidification unit 140 is guided by the flow path control unit. In this regard, the flow path control unit may be configured in a selective manner such that the flow of air from the filter unit 130 to the humidification unit 140 is blocked to cause the air to directly flow toward the discharge port 120, or the flow of air toward the humidification unit 140 is allowed so that the air passed through the filter unit 130 is humidified.

More specifically, through the operation of the flow path control unit, the apparatus is provided with two selective flow paths, that is, an air purification path (A) in which the purified air, which is filtered by the filter unit 130, flows toward the discharge port 120 through a space before or behind the circulation fan 125, and an air purification and humidification path (B) in which the purified air, filtered by the filter unit 130, is humidified by the humidification unit 140 and flows toward the discharge port 120 through the space before or behind the circulation fan 125.

At this point, the flow path control unit may be swingably supported in the case 100 so as to be moved between a first position in which the flow path control unit blocks the air purification and humidification path (B) such that the purified air passed through the filter unit 130 flows through the air purification path (A), and a second position in which the flow path control unit blocks the air purification path (A) such that the purified air passed through the filter unit 130 flows only through the air purification and humidification path (B).

In addition, the flow path control unit may further provide a third position in which some of the purified air passed through the filter unit 130 flows through the air purification path (A) and the remainder of the purified air passed through the filter unit 130 flows through the air purification and humidification path (B). The third position may be positioned between the first position and the second position.

Referring to FIGS. 2 to 6, operation of the apparatus for purifying and humidifying air according to an embodiment of the present invention will be described in detail. FIGS. 2 and 3 show the flow path control unit which is in the first position. In this embodiment, the flow path control unit includes a rotating plate 150 having a rotating shaft 151 (see FIG. 6), which is swingably supported in the front of the humidification unit 140 in order to block or allow the flow of air from the filter unit 130 to the humidification unit 140.

FIG. 3 shows the rotating plate 150 which is in the first position. In the case of intending to achieve only air purification, the rotating plate 150 is in the first position, that is, the position in which the air purification and humidification path (B) is blocked. More specifically, in the position in which the rotating plate 150 blocks the air purification and humidification path (B), the rotating plate 150 is moved to obstruct the front side of the humidification unit 140 so as to prevent the passage of air through the humidification unit 140. In this case, the apparatus for purifying and humidifying air creates only purified air and discharges the purified air outside. In other words, the air introduced in the case 100 is purified through the filter unit 130, and the purified air flows along the air purification path (A) and is discharged outside through the discharge port 120.

FIG. 4 shows the rotating plate 150 which is in the second position. As shown in the drawing, the rotating plate 150 is in the second position, that is, the position in which the air purification path (A) is blocked. At this point, the air purification path (A) is positioned over the air purification and humidification path (B). More specifically, in the position in which the rotating plate 150 blocks the air purification path (A), the rotating plate 150 is moved to obstruct the air purification path (A) above the humidification unit 140 so as to prevent the passage of air through the air purification path (A). Consequently, the air introduced in the case 100 is purified through the filter unit 130, and the purified air is humidified by the humidification unit 140. Thereafter, the humidified air flows along the air purification and humidification path (B) and is discharged outside through the discharge port 120 with the aid of the drawing action of the circulation fan 125.

As described above, since the apparatus for purifying and humidifying air according to the embodiment of the present invention is constructed to provide the air purification and humidification path (B) as well as the air purification path (A), either the purified air or the purified and humidified air may be selectively produced, thus allowing control of a discharge amount of humidified air, in accordance with a user's selection.

The apparatus for purifying and humidifying air according to the embodiment of the present invention may produce a mixture of the purified air and the purified and humidified air if necessary. To this end, the rotating plate 150 may be moved to the third position between the first position and the second position. FIG. 5 shows the rotating plate 150 which is in the third position.

As shown in the drawing, the rotating plate 150 is disposed in the third position, that is, between the air purification path (A) and the air purification and humidification path (B). Accordingly, the air, which is introduced in the case 100 through the filter unit 130, flows through both the air purification path (A) and the air purification and humidification path (B). The purified air and the purified and humidified air are discharged outside through the discharge port 120 with the aid of the drawing action of the circulation fan 125.

In other words, the rotating plate 150 is rotated by drive power from a drive unit (not shown) provided in the case 100. When the rotating plate 150 is moved to be inclined upwards (the second position), the air, which is introduced in the case 100 through the suction port 110, is directed toward the humidification unit 140 and is then humidified by the humidification unit 140. When the rotating plate 150 is moved to be inclined downwards (the first position), the flow of air toward the humidification unit 140 is obstructed and thus the air introduced in the case 100 is directly discharged outside through the discharge port 120 by the drawing action of the circulation fan 125. In this embodiment, the drive unit includes a step motor.

The air purification path (A) and the air purification and humidification path (B), which are shown in FIGS. 3 and 4, are substantially identical to each other in terms of the adoption of the dual paths composed of a front flow path 170 defined between the front side of the circulation fan 125 and the filter unit 130 and a rear flow path 175 defined between the rear side of the circulation fan 125 and the case 100. In order words, even though the rotating plate 150 which serves as the flow path control unit, is moved to any of the first to third positions, the air introduced in the case 100 flows through both the front flow path 170 and the rear flow path 175 concurrently.

The flow path control unit functions to guide the flow of air toward the humidification unit 140 from the suction port 110. In addition to the embodiment in the form of the rotating plate 150, the flow path control unit may be embodied in a variety of manners in the front of the humidification unit 140.

Figure 8:
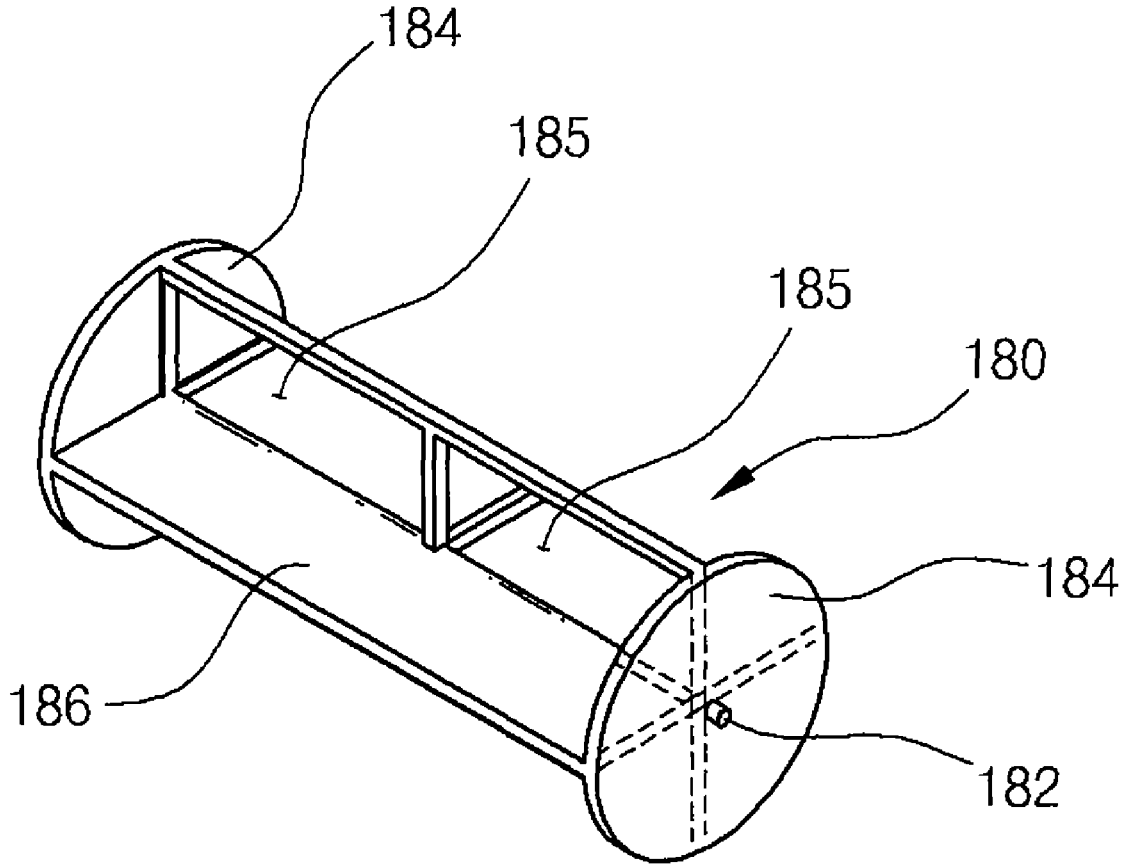
FIG. 8 is a perspective view of a mill wheel-shaped rotating plate, which is a modification of the flow path control unit according to the embodiment of the present invention.
Figure 9:
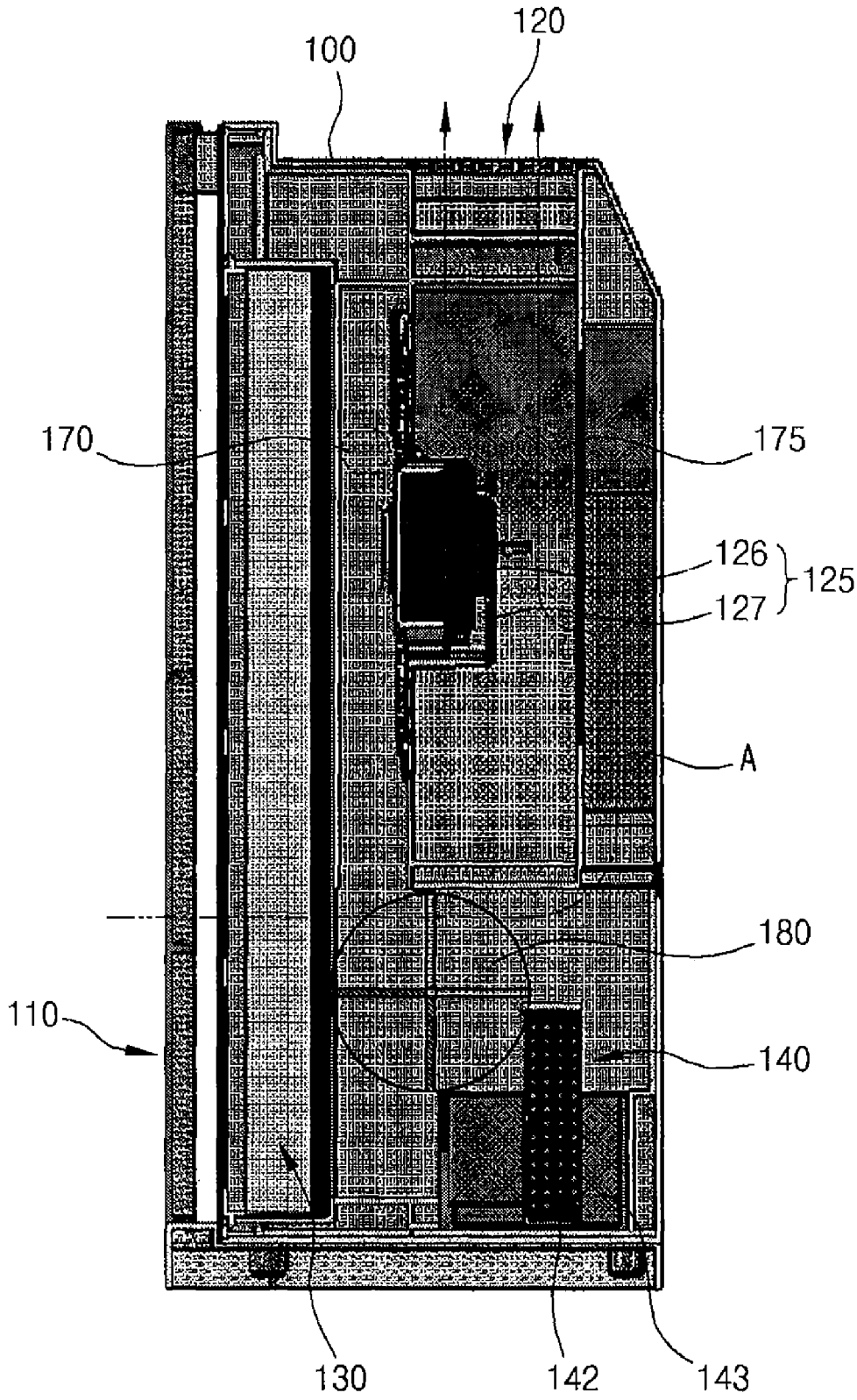
FIG. 9 is a side cross-sectional view of the apparatus for purifying and humidifying air which includes the modification of the flow path control unit shown in FIG. 8, in which the mill wheel-shaped rotating plate is in the first position.
Figure 10:
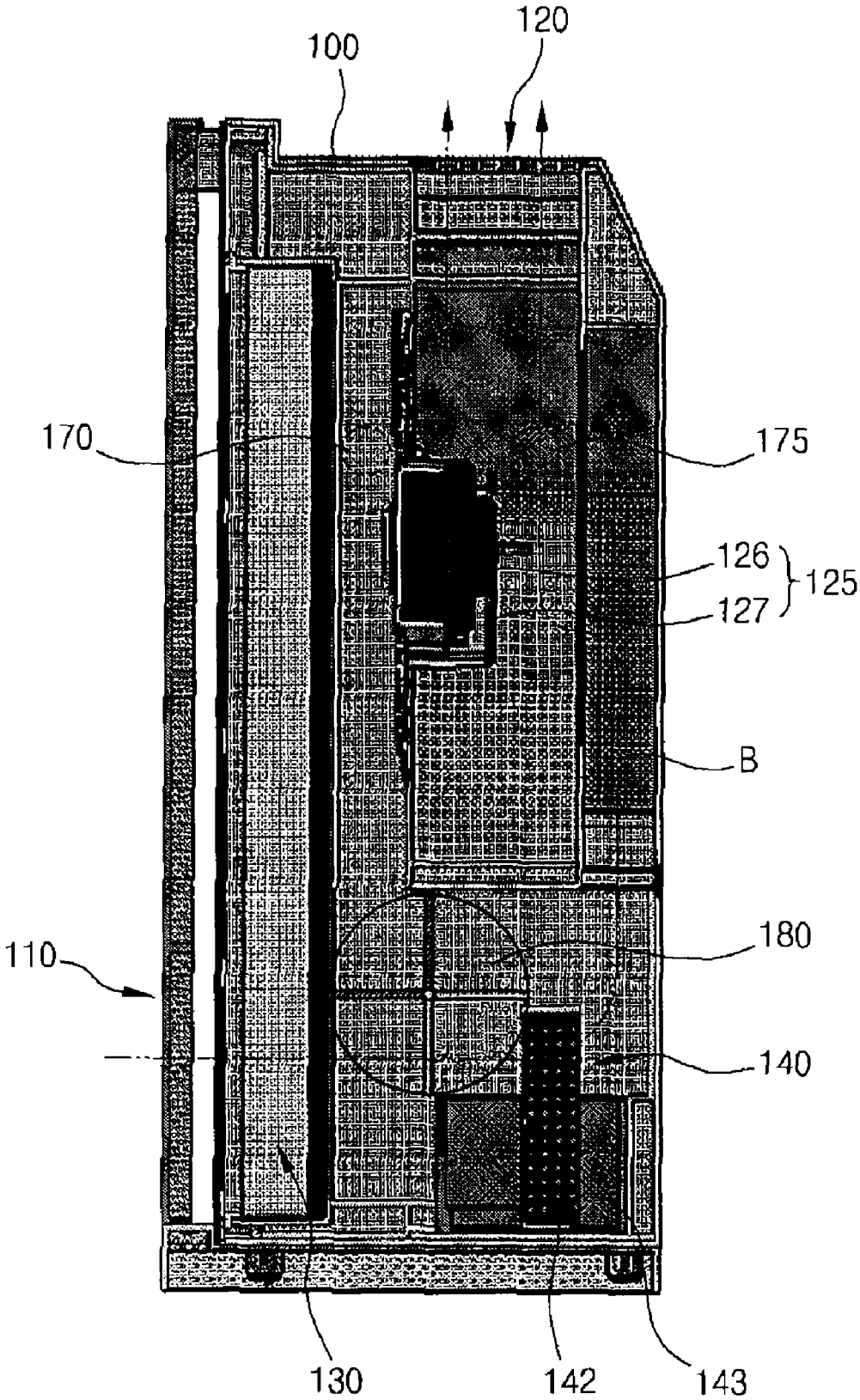
FIG. 10 is a side cross-sectional view showing the apparatus for purifying and humidifying air which includes the modification of the flow path control unit shown in FIG. 9, in which the mill wheel-shaped rotating plate is in the second position.

FIG. 8 is a perspective view of a mill wheel-shaped rotating plate, which is a modification of the flow path control unit according to the embodiment of the present invention, FIG. 9 is a side cross-sectional view of the apparatus for purifying and humidifying air which includes the modification of the flow path control unit shown in FIG. 8, in which the mill wheel-shaped rotating plate is in the first position, and FIG. 10 is a side cross-sectional view showing the apparatus for purifying and humidifying air which includes the modification of the flow path control unit shown in FIG. 9, in which the mill wheel-shaped rotating plate is in the second position.

Referring to FIGS. 8 to 10, the flow path control unit may be embodied as the mill wheel-shaped rotating plate 180. The mill wheel-shaped rotating plate 180 includes a rotating shaft 182, and the opposite ends of the mill wheel-shaped rotating plate 180 are coupled to support plates 184. The rotating shaft 182 is connected to a drive unit (not shown), and is thus rotated by drive power transferred from the drive unit. The mill wheel-shaped rotating plate 182 includes four blades which converge at the rotating shaft 182 to define a cruciform section. Two of the four blades serve as blocking blades 186, and the other two blades serve as opening blades 185. Of course, the number of the blades and the numbers of the blocking blades and of the opening blades may be changed depending on a user's needs.

When the mill wheel-shaped rotating plate 180 is moved to the first position as shown in FIG. 9, the blocking blades 186 are disposed in the front of the humidification unit 140 thus blocking the air purification and humidification path (B) whereas the opening blades 185 are disposed in the air purification path (A) thus allowing the purified air to pass therethrough. As a result, only the purified air is discharged through the discharge port 120. When the mill wheel-shaped rotating plate 180 is rotated by 90 degrees and is thus moved to the second position as shown in FIG. 10, the blocking blades 186 are disposed to block the air purification path (A) whereas the opening blades 185 are disposed in the air purification and humidification path (B). As a result, only the purified and humidified air is discharged through the discharge port 120. Also in this modification, a mixture of the purified air and the purified and humidified air may be produced by changing the rotating angle of the mill wheel-shaped rotating plate 180 to control positions of the opening blades 185 and the blocking blades 186.

Figure 11:
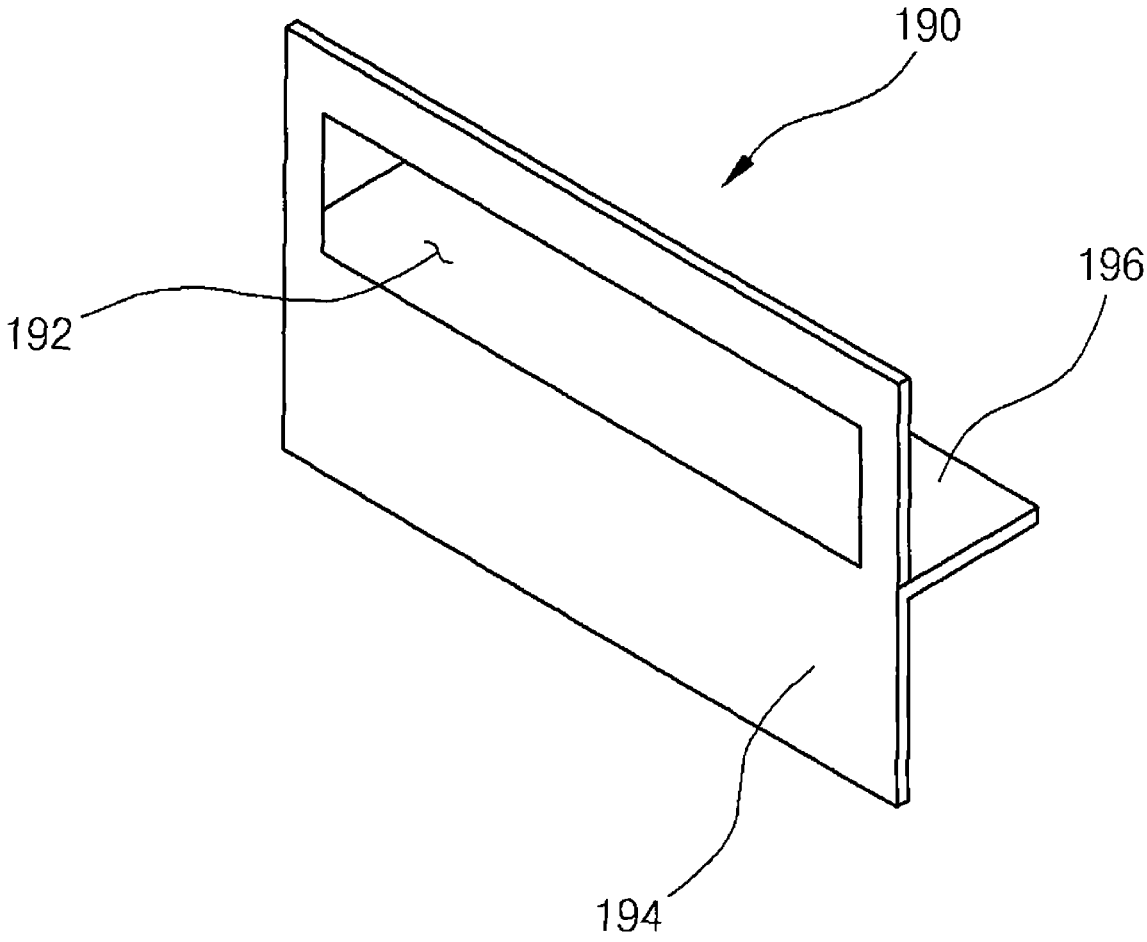
FIG. 11 is a perspective view of a sliding plate, which is another modification of the flow path control unit according to the embodiment of the present invention.
Figure 12:
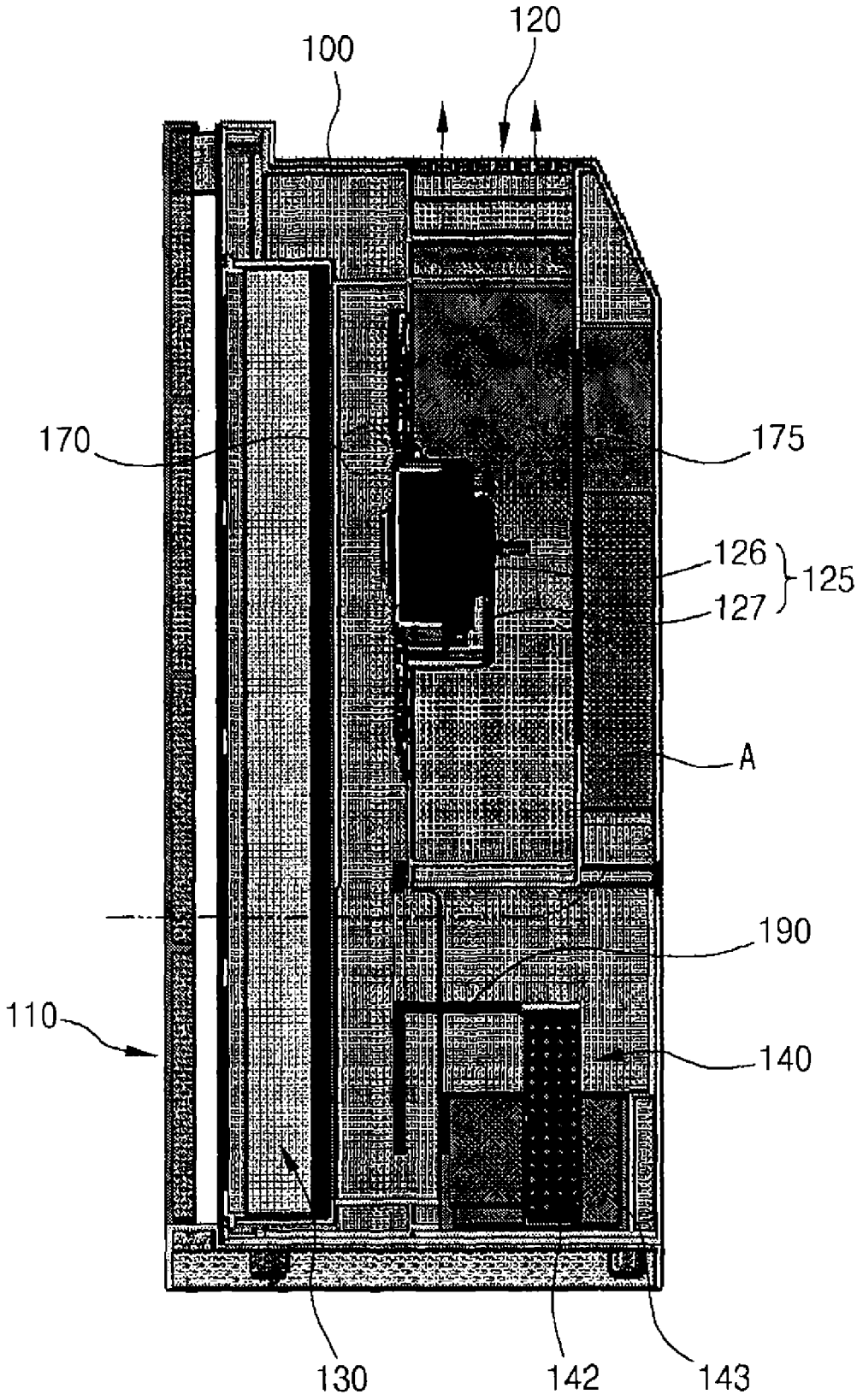
FIG. 12 is a side cross-sectional view of the apparatus for purifying and humidifying air which includes another modification of the flow path control unit, in which the sliding plate is in the first position.
Figure 13:
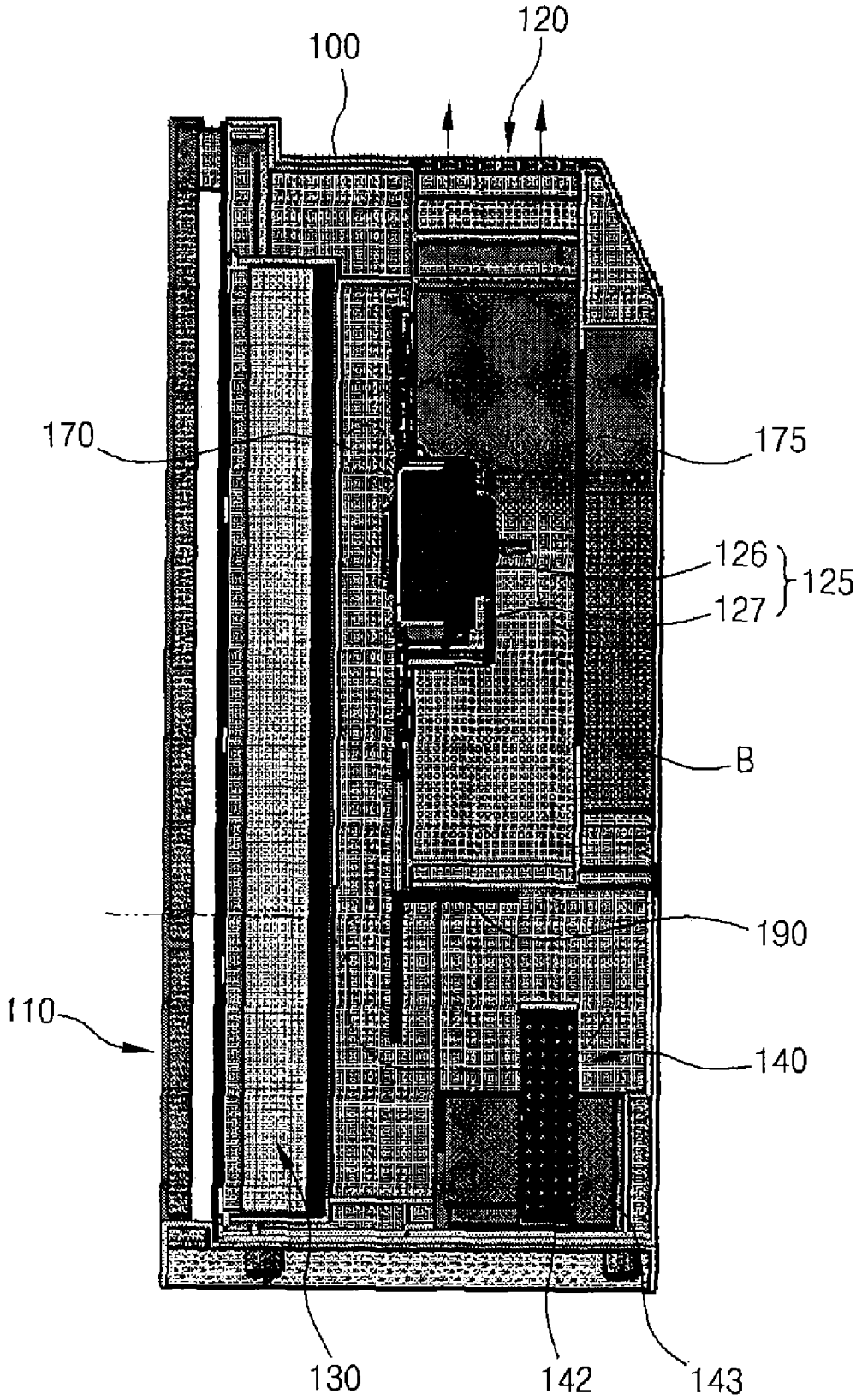
FIG. 13 is a side cross-sectional view showing the apparatus for purifying and humidifying air which includes the another modification of the flow path control unit, in which the sliding plate is in the second position.

FIG. 11 is a perspective view of a sliding plate, which is another modification of the flow path control unit according to the embodiment of the present invention, FIG. 12 is a side cross-sectional view of the apparatus for purifying and humidifying air which includes the another modification of the flow path control unit, in which the sliding plate is in the first position, and FIG. 13 is a side cross-sectional view showing the apparatus for purifying and humidifying air which includes the another modification of the flow path control unit, in which the sliding plate is in the second position.

Referring to FIGS. 11 to 13, the flow path control unit may be embodied as the sliding plate 190. In this case, the case 100 may be provided therein with an additional guide path (not shown), and the opposite ends of the sliding plate 190 can be slid up and down along the guide path. The sliding plate 190 may also be moved by the connection to a drive unit (not shown). The sliding plate 190 comprises three blades, i.e., an upper opening blade 192, a lower blocking blade 194 and a guide blade 196 extending from the upper and lower blades to be perpendicular thereto.

When the sliding plate 190 is disposed in the first position as shown in FIG. 12, the blocking blade 194 is positioned in the front of the humidification unit 140 thus blocking the air purification and humidification path (B), whereas the opening blade 192 is positioned in the air purification path (A) thus allowing the purified air to pass therethrough. As a result, only purified air is discharged outside through the discharge port 120. When the sliding plate 190 is disposed in the second position as shown in FIG. 13, the blocking blade 194 is positioned to block the air purification path (A) and the air purification and humidification path (B) is open, with the result that only purified and humidified air is discharged outside through the discharge port 120.

During movement of the sliding plate 190, the guide blade 196 comes into contact with the upper end of the humidification unit 140 thus guiding the movement of the sliding plate 190. Also in this modification, mixture of the purified air and the purified and humidified air may be produced by changing positions of the opening blade 192 and the blocking blade 194.

The drive unit (not shown) which supplies drive power to the flow path control unit may be controlled by a controller (not shown) in response to a signal received from an input unit (not shown) provided on the case 100.

As described above, the apparatus for purifying and humidifying air, according to the present invention provides the air purification path and the air purification and humidification path, which are separately configured and selectively opened by the flow path control unit. Consequently, the amount of purified air and the amount of purified and humidified air can be controlled depending on seasonal change or ambient environment, thus improving convenience for the user.

In addition, the dual flow paths are provided before and behind the circulation fan, thus improving the transfer efficiency of purified air or purified and humidified air.

Although the preferred embodiment of the present invention has been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. An apparatus for purifying and humidifying air, comprising:

a case having a suction port through which external air is introduced thereinto and a discharge port through which the introduced air is discharged;

a circulation fan for causing the introduced air to flow to the discharge port;

a filter unit disposed in the case to filter the introduced air;

a humidification unit disposed at a low position in the case to supply the air passed through the filter unit with moisture;

a flow path control unit disposed between the suction port and the humidification unit to control flow of the air passed through the filter unit; and dual flow paths composed of a front flow path defined between a front side of the circulation fan and the filter unit and a rear flow path defined between a rear side of the circulation fan and the case.

2. The apparatus according to claim 1, wherein the flow path control unit is operated to selectively provide access to an air purification path in which the purified air passed through the filter unit flows through at least one of spaces before and behind the circulation fan and toward the discharge port; or to an air purification and humidification path in which the purified air passed through the filter unit is humidified by the humidification unit and then flows through at least one of the spaces before and behind the circulation fan and toward the discharge port.

3. The apparatus according to claim 2, wherein the flow path control unit is supportably mounted in the case, and is moved between a first position in which the flow path control unit blocks the air purification and humidification path to allow the air passed through the filter unit to flow through the air purification path, and a second position in which the flow path control unit blocks the air purification path to allow the air passed through the filter unit to flow through only the air purification and humidification path.

4. The apparatus according to claim 3, wherein the flow path control unit is moved to a third position in which some of the air passed through the filter unit flows through the air purification path and the remainder of the air passed through the filter unit flows through the air purification and humidification path, wherein the third position is positioned between the first position and the second position.

5. The apparatus according to claim 3, wherein the flow path control unit includes a rotating plate having a rotating shaft, in which the rotating shaft is rotated using drive power from a drive unit and the rotating plate is rotatably moved about the rotating shaft as central axis between the first position and the second position.

6. The apparatus according to claim 3, wherein the flow path control unit includes a mill wheel-shaped rotating plate rotatably moved between the first position and the second position having a rotating shaft, in which the rotating shaft is rotated using drive power from a drive unit and the mill wheel-shaped rotating plate includes a support plate coupled to an end of the rotating shaft and four blades supported to the support plate and having a cruciform section extending from the rotating shaft, wherein at least one of the four blades has an opening area and a remainder of the four blades have a blind area.

7. The apparatus according to claim 3, wherein the flow path control unit includes a sliding plate disposed behind and close to the filter unit, in which the sliding plate is slidably moved between the first position and the second position using drive power from a drive unit and has an upper opening area and a lower blind area.

8. The apparatus according to claim 2, wherein each of the air purification path and the air purification and humidification path is the dual flow paths.

9. The apparatus according to claim 1, wherein the humidification unit is disposed below the circulation fan.

10. The apparatus according to claim 1, wherein the humidification unit comprises a humidification filter containing moisture and supplying air with the moisture, and a water tank accommodating a part of the humidification filter immersed therein and supplying the humidification filter with water.

11. The apparatus according to claim 5, wherein the drive unit is controlled by a controller in response to a signal received from an input unit provided outside the case.

12. The apparatus according to claim 1, wherein the circulation fan comprises a double fan type which includes front and rear impellers to cause introduction of air through the suction port of the case.

* * * * *